United States Patent [19]

Harris et al.

[11] 4,037,556

[45] July 26, 1977

[54] BOAT STEERING MECHANISM FOR OUTBOARD MOTOR

[76] Inventors: Garrett H. Harris, 157 S. Denver, Jackson, Miss. 39209; Louis M. Harris, 2423 W. Mulberry, San Antonio, Tex. 78228

[21] Appl. No.: 626,305

[22] Filed: Oct. 28, 1975

[51] Int. Cl.[2] ..... B63H 25/42; B63H 21/26

[52] U.S. Cl. ..... 115/18 R; 114/144 RE; 115/18 E

[58] Field of Search ..... 114/144 RE, 144 A, 153; 115/18 RE, 18 R; 318/673, 588

[56] References Cited

U.S. PATENT DOCUMENTS

| | | | |
|---|---|---|---|
| 735,550 | 8/1903 | Merrill | 114/144 E |
| 1,932,785 | 10/1933 | Irgens | 115/18 R |
| 2,804,838 | 9/1957 | Moser | 114/153 X |
| 2,810,875 | 10/1951 | Mayer et al. | 318/673 X |
| 2,877,733 | 3/1959 | Harris | 114/153 X |

*Primary Examiner*—Stephen G. Kunin
*Assistant Examiner*—Gregory W. O'Connor
*Attorney, Agent, or Firm*—James W. Pearce; Roy F. Schaeperklaus

[57] ABSTRACT

Steering mechanism for a boat motor having a shaft which turns to turn the boat motor. A plurality of first contacts is spaced circumferentially around the shaft. A sweep contact mounted on the shaft sequentially engages the first contacts as the shaft turns. A pivotally mounted pedal swings a contact plate. A plurality of second contacts, each of which is connected to a respective one of the first contacts, is engageable with the contact plate. Upon movement of the pedal power is supplied to the steering motor until the sweep contact engages one of the first contacts which is connected to a second contact that is free of the contact plate. The contact plate can include two contact plate portions, one of which is connected in series with the steering motor when the pedal is moved in one direction and the other of which is connected in series with the steering motor when the pedal is moved in an opposite direction. Polarity of the connection to the steering motor is reversed as the connection with contact plate portions is changed to reverse the direction of steering motor advance.

21 Claims, 8 Drawing Figures

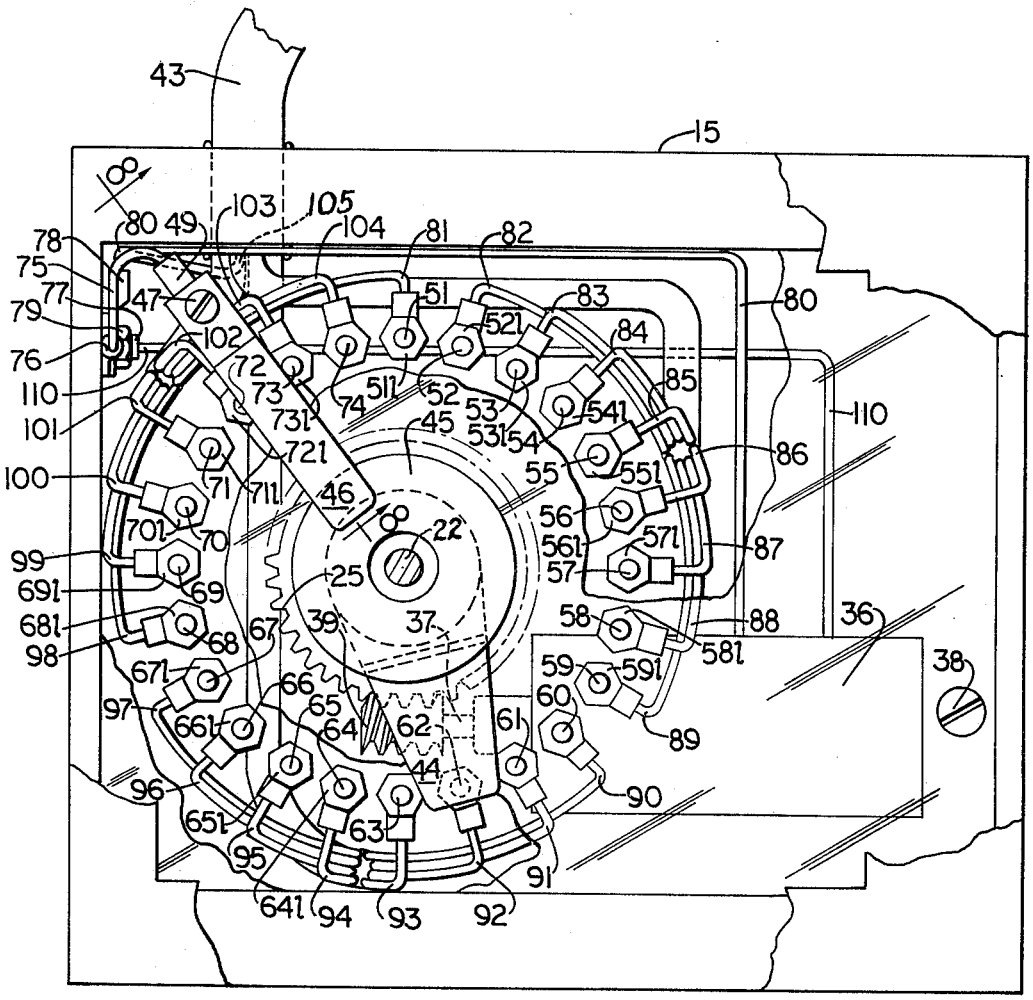
FIG. 2
FIG. 3
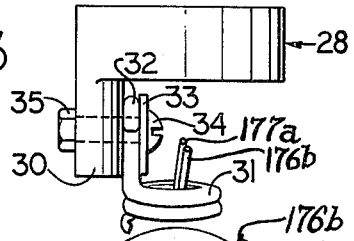
FIG. 4
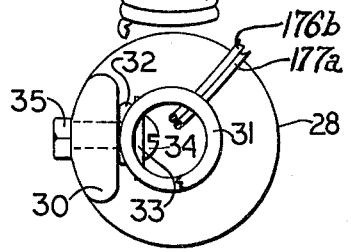

BOAT STEERING MECHANISM FOR OUTBOARD MOTOR

This invention relates to devices for steering and propelling boats and, more particularly, to an electrical system for conveniently controlling the direction of travel of a boat when propelled by an outboard motor.

A further object of this invention is to provide a steering control in which a foot pedal is manipulatable to control change in electrical positioning of an outboard motor in successive positions wherein it is mechanically locked.

Another object of this invention is to provide a steering control system for boats wherein the boat propelling motor is re-positioned in response to re-positioning of a foot pedal, re-positioning of which causes the supply of electric power to motor re-positioning means, which supply of power continues until the motor is re-positioned in the position which corresponds to the correlated position of the pedal.

A further object of this invention is to provide a steering control system for boats which consumes electric power only during re-positioning of the boat propulsion motor.

A futher object of this invention is to provide electric steering control means by which the propulsion motor of a boat may be positioned so that upon operation of the steering control means, the propulsion thrust may be directed as desired within 360° of arc of steering positioning.

A further object of this invention is to provide means in which the foot pedal pivots through an angle less than 360° while the propulsion motor may be positioned in selected positions within 360° and which pedal frictionally locks in selected position.

A further object of this invention is to provide a foot pedal control having means for selecting the direction of rotation of the propulsion motor to the newly selected steering position and the newly selected position.

A further object of this invention is to provide an electric outboard motor propulsion unit having a steering control system embodying the instant invention and in which means are provided for protecting the steering system from damaging mechanical shocks produced by collision of portions of the outboard motor with foreign objects.

Briefly, this invention provides steering mechanism for a boat motor having a shaft which turns to turn the boat motor. A plurality of first contacts is spaced circumferentially around the shaft. A sweep contact mounted on the shaft sequentially engages the first contacts as the shaft turns. A pivotally mounted pedal swings a contact plate means. A plurality of second contacts, each of which is connected to a respective one of the first contacts, is engageable with the contact plate means. Upon movement of the pedal, power is supplied to the steering motor until the sweep contact emerges one of the first contacts which is connected to a second contact that is free of the contact plate means. The contact plate means can include two contact plate portions, one of which is connected in series with the steering motor when the pedal is moved in one direction and the other of which is connected in series with the steering motor when the pedal is moved in an opposite direction. Polarity of the connection to the steering motor is reversed as the connection with contact plate portions is changed to reverse the direction of steering motor advance.

The above and other objects, features and advantages of the invention will in part be obvious and in part apparent to those having ordinary skill in the art to which this invention pertains, from the following detailed description and the drawings, in which:

FIG. 2 is a top plan view, partly broken away, of the portion of the device shown in FIG. 1;

FIG. 3 is a fragmentary view taken on the line 3—3 in FIG. 1;

FIG. 4 is a fragmentary view taken on the line 4—4 in FIG. 1;

In the following detailed description and the drawings, like reference characters indicate like parts.

The illustrative embodiment of the instant invention presently appears to be the preferred embodiment thereof.

The preferred embodiment is for use in connection with an electric outboard boat propulsion motor otherwise similar in construction to those frequency used by fishermen while fishing and which are often mounted on the bow of a boat. Such motors and mountings therefor on a boat outboard thereof are already known, as illustrated, for example in U.S. Pat. No. 3,602,181.

In the mentioned patent a foot-controlled, mechanical steering structure is disclosed. The present structure provides electrical operation of the steering mechanism, thereby providing a more convenient remote location of the foot pedal and also providing mechanical locking of the outboard motor in a particular selected steering-position, as well.

Figure 1:
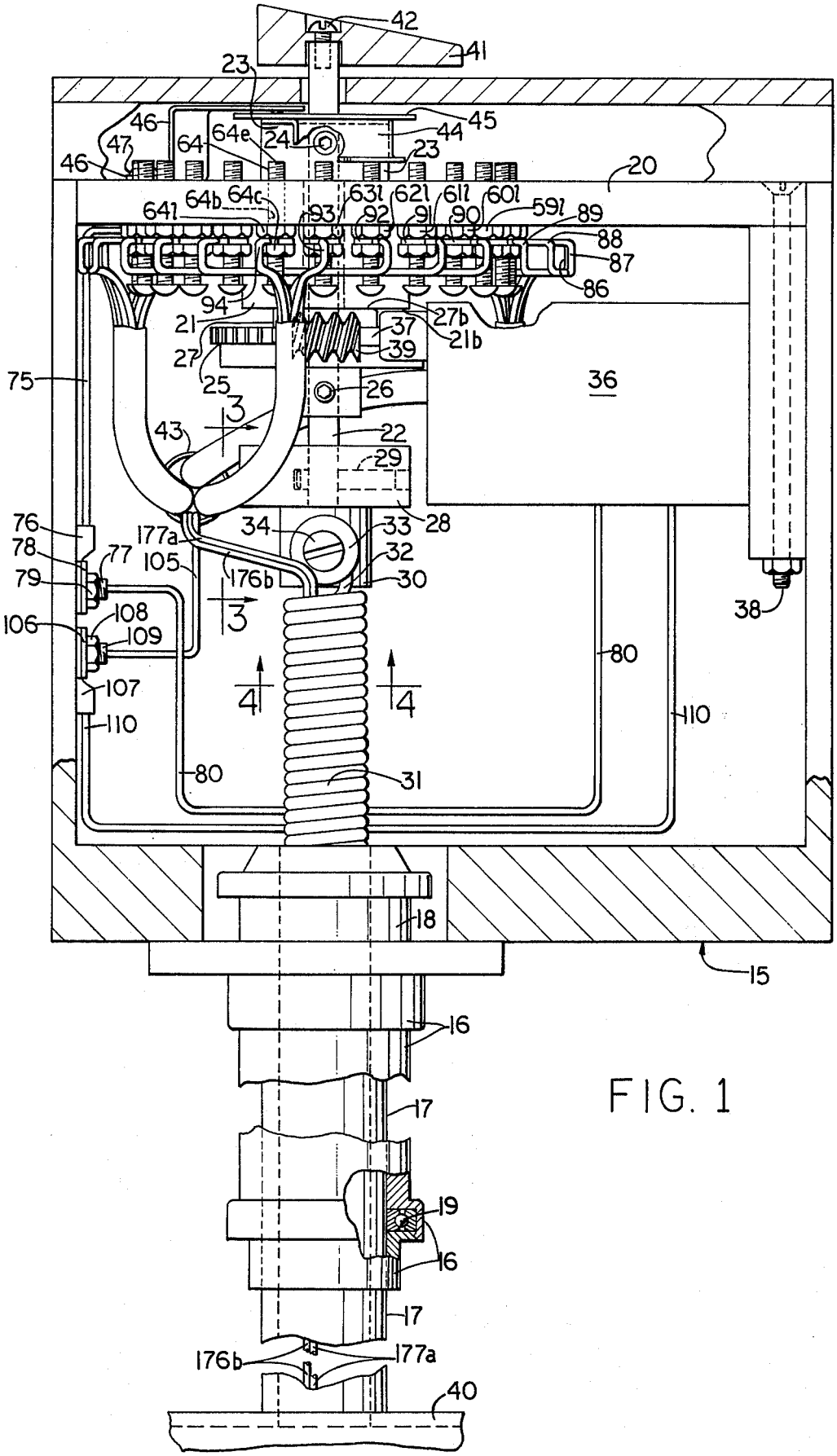
FIG. 1 is a view in side elevation, partly in section, of a portion of an outboard electric motor which embodies the instant invention.

In FIGS. 1 and 2 is shown a housing 15 which is part of an electric outboard motor and which may be mounted in fixed position relative to a boat, outboard thereof when the outboard motor is in operative position for propelling the boat. Carrier 16 extends downwardly from housing 15 in fixed relation thereto. A hollow staff 17 extends through carrier 16 and is journalled in bearing 18 (shown in FIG. 1) and in a second bearing 19 supported in carrier 16 adjacent the lower end thereof. Staff 17 extends downwardly beyond the lower end of carrier 16 and supports at its lower end propulsion motor 40 in fixed relation to staff 17, such that rotation of staff 17 results in turning of the housing 40 so as to swing the propulsion motor shaft about the upright axis of staff 17. As shown in FIGS. 1 and 2, a bulkhead 20 is provided in housing 15 and is preferably a non-conductor of electricity. Steering shaft 22 is journalled in bulkhead 20 in coaxial relation to staff 17, and, as shown, bulkhead 20 has an integral boss 21 thickening the portion of the bulkhead through which steering shaft 22 extends in journalled relation. Shaft 22 may be of steel or other suitable material. An insulative bearing collar 23 is secured in fixed relation to shaft 22 by set screw 24 to provide a radial shoulder face which cooperates with the upper face of bulkhead 20, as shown in FIG. 1, to thereby preclude movement of steering shaft 22 toward shaft 17. A worm wheel 25 is secured to steering shaft 22 by set screw 26. Worm wheel 25 has an integral upwardly extending shoulder hub 27. The upwardly facing radial face 27*b* of shoulder hub 27 is a bearing face annularly of shaft 22 and cooperatively engages downwardly facing opposed bearing face 21*b* of boss 21. Thus, collar 23 and shoulder hub 27 cooperate with opposite faces of bulkhead 20 (and its integral boss 21) to secure shaft 22 against shifting in its axial direction. Shaft 22 is coupled to staff 17 by coupling crank 28 secured to shaft 22 by set screw 29. Crank arm 30 extends parallel to the axis of shaft 22 and is spaced radially outwardly therefrom, as shown in FIGS. 3 and 4. Hollow helical torsion spring 31 has an end eyelet portion 32 disposed between arm 30 and clamp washer 33 and is secured in fixed relation to arm 30 by screw bolt 34 which cooperates with nut 35. The lower end of spring 31 is secured to staff 17. Spring 31 and crank 28 thus couple shaft 22 and staff 17 for unison rotation and secure them in substantially fixed relation to each other while permitting limited relative turning of staff 17 relative to shaft 22 as when staff 17 is subjected to twisting forces as the result of a collision of the motor case 40 or the propeller supported in relation thereto with some foreign object as, for example, a rock or other underwater obstruction. Torsion spring 31 thus functions as a shock absorbing protective coupling between the steering shaft 22 and the motor staff 17. A motor 36 having output shaft 37 is mounted as by screw bolt 38 in fixed relation in the casing 15. Worm 39 is mounted on shaft 37 in cooperative continuously meshing relation with the teeth of worm wheel 25. Thus, worm 39 secures worm wheel 25 and the structure coupled to it, including staff 17, against rotation about the axis of staff 17 at all times when motor 36 is not operating (and no abnormal external force is turning staff 17 relative to shaft 22), and repositioning of staff 17 by rotation about its axis may be accomplished by operating motor 36 to drive worm 39 to rotate worm wheel 25 through an angle as is necessary to turn staff 17 to support motor 40 in the position desired.

As shown in FIG. 1, shaft 22 projects upwardly through an aperture in the top of housing 15. A pointer 41 is secured thereto by screw 42. Pointer 41 is positioned to indicate the direction in which propulsion motor 40 tends to advance and thus provides a visually observable indication of the steering position of the submerged motor 40.

The portion of the electric circuit involved in operation of steering motor 36 and contained in housing 15 is as follows. A plurality of contacts are mounted in bulkhead 20 annularly of shaft 22 and equally spaced radically from the shaft. The contacts are respectively designated by the reference characters 51 through 74, inclusive. As each of the contacts shown is constructed like the others, contact 64 will be described in detail with the understanding that the other contacts are of like construction. Contact 64 consists of a screw threadedly engaged in a threaded bore 64*b* in bulkhead 20. Rotation of the screw may be effected to adjust it axially for positioning the upper end thereof 64*e* to place same in operative postion, and locknut 641 may be tightened to engage the under face of bulkhead 20 to lock the screw in desired position. A second nut 64*c* may be rotated to advance along screw 64 to clamp electrical conductor 94 against the opposed face of nut 641, thereby establishing secure electro-conductive attachment of conductor 94 to contact 64. Conductor 94 is connected to contact 64 and in like manner conductors 81 through 104 are respectively secured to contacts 51 through 74. The conductors 81 through 104 together form one leg of the control circuit for steering motor 36 in cable 43 while a conductor 105 in that cable forms the other leg of the steering motor circuit therein. Conductor 105, as shown in FIG. 1, has an end lug 106.

Figure 8:
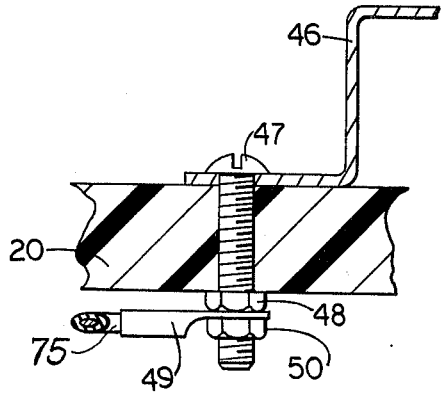
FIG. 8 is a fragmental view in section, partly broken away, taken on the line 8—8 in FIG. 2.

Secured to insulative bearing collar 23 is a wiper contact arm 44, the end portion of which remote from collar 23 is adapted to electro-conductively cooperate with contacts 51–74, as is hereinafter more particularly described. A contact ring 45 is mounted on insulative bearing collar 23 in concentric relation to shaft 22 and in electro-conductive relation to wiper contact arm 44 with the result that contact arm 44 and ring 45 move with collar 23 to function as a rotary contact. A brush contact 46 is mounted on bulkhead 20 by screw 47 which extends through brush 46 and bulkhead 20 in threaded engagement with the latter. Nut 48 (FIG. 8) in threaded cooperation with screw 47 may be rotated relative thereto in engagement with bulkhead 20 to lock screw 47 in fixed relation to the bulkhead and thereby secure the portions of brush 46 annularly of screw 47 in fixed relation to bulkhead 20. Terminal lug 49 is secured on screw 47 between clamp nut 50 and the previously mentioned lockout 48. Terminal lug 49 is secured to conductor 75 (FIG. 2) on the opposite end of which is terminal lug 76 which is in cooperative relation to binding screw post 77 and terminal lug 78. Terminal lug 78 is secured in firm abutment with lug 76 by binding nut 79. Lug 78 is also secured to the end of conductor 80 which forms one lead from motor 36. The second lead from motor 36 is conductor 110 which extends from motor 36 to terminal lug 107 received in cooperation upon binding screw post 109 in cooperation with which there is a second terminal lug 106. Nut 108 on binding post 109 serves to clamp lugs 110 and 106 in firm abutting contact. Lug 106 is also secured to conductor 105 which is also a conductor extending through cable 43.

Figure 5:
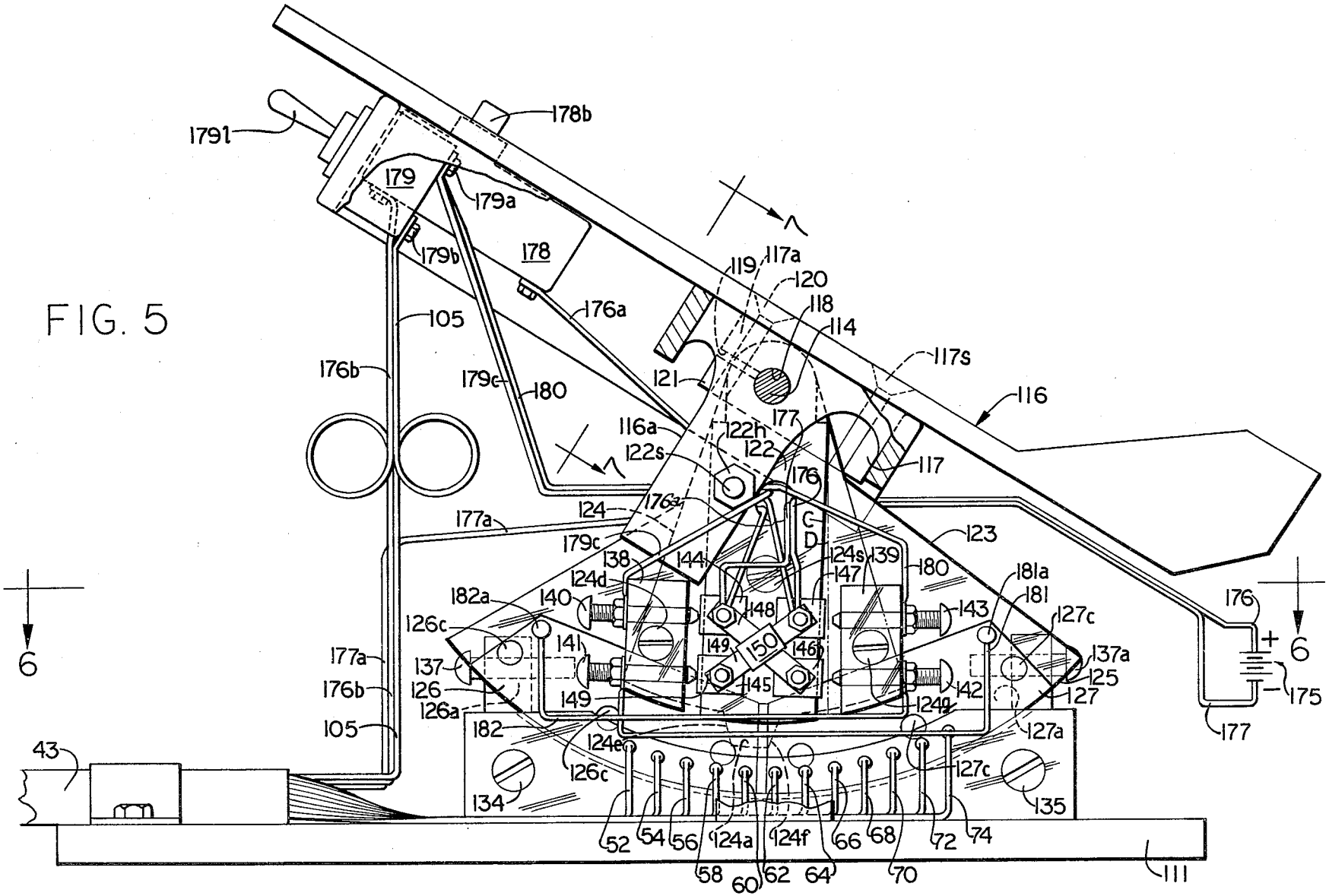
FIG. 5 is a view in side elevation, partly broken away and in section, of a foot pedal forming part of an electric outboard motor embodying the instant invention.
Figure 6:
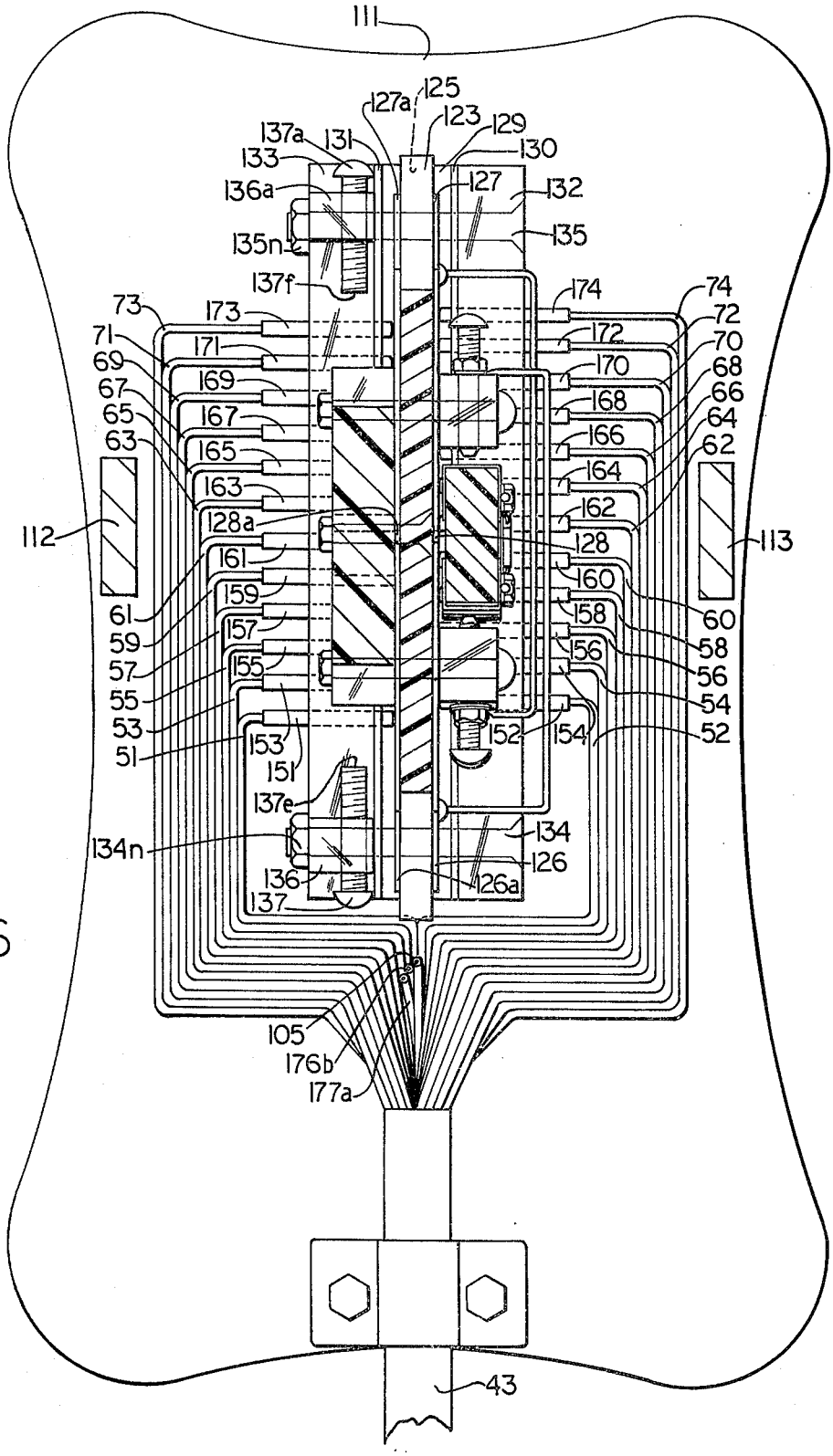
FIG. 6 is a fragmentary view in horizontal section taken generally on line 6—6 in FIG. 5.
Figure 7:
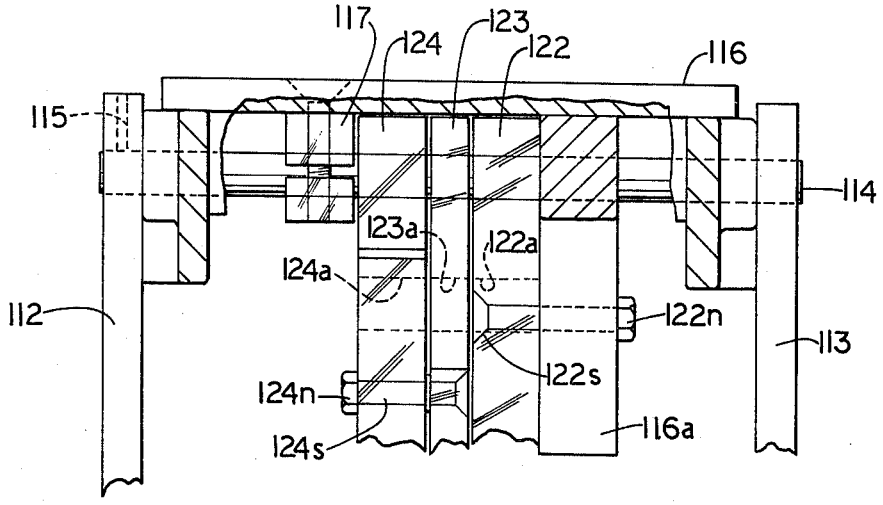
FIG. 7 is a fragmental view in section, partly broken away, taken on the line 7—7 in FIG. 5.

FIGS. 5, 6 and 7 show a remote steering and propulsion control manipulatable by the operator's foot. The foot control has a base 111 which may rest on the deck of the boat and may be equipped on its under face with antislip devices such as a rubber facing or the like (not shown). A pair of integral pillars 112–113 extend upwardly from base 111 and support a horizontal shaft 114 which is secured in position and against rotation by set screw 115.

A foot pedal 116 is pivotally supported on fixed shaft 114 for rocking movement relative to the axis of shaft 114. Pedal 116 also has a depending arm 116*a* having an aperture through which shaft 114 also extends, as shown in FIGS. 5 and 7. Spaced from arm 116*a* is a split clamp 117 secured in fixed relation to the underside of pedal 116 by screw 117*s* and as shown in FIG. 5. Split clamp 117 has an aperture 118 in which shaft 114 is received. The toeward end of split clamp 117 has a slot 119 extending to aperture 118. Screw 120 extends through pedal 116, the portion of clamp 117 extending from the pedal to slot 119, spans slot 119 and then is threaded in engagement with arm 121 of the clamp so that rotation of screw 120 tends to shift arm 121 relative to pedal 116 thereby increasing or decreasing the frictional gripping of clamp 117 on fixed shaft 114.

Pivotally supported on shaft 114 between pedal arm 116a and pedal clamp 117 are switch level 122 (FIG. 7), contact lever 123 and limit lever 124. Levers 122, 123 and 124 are shown as made of insulating, that is, non-electroconducting, material and are pivotable about shaft 114 but their movements about that shaft are limited and related to movement and cooperation with other portions of the structure as will be subsequently pointed out.

Switch lever 121 is secured to pedal arm 116*a* by screw 122*s* which threadably cooperates with nut 122*n* such that arm 122 moves in unison with arm 116*a.* Similarly, contact lever 123 and limit lever 124 are coupled together by screws 124*d* (FIG. 5), 124*g,* 124*s* which threadably cooperate with respective nuts 124*n* such that contact lever 123 and limit lever 124 swing in unison with each other.

As shown in FIGS. 5 and 6, contact lever 123 extends toward base 111 and has a cylindrical lower edge face 125 coaxial with the axis of shaft 114. Contact plates 126, 126*a,* 127, and 127*a* are mounted on the side faces of contact lever 123 adjacent cylindrical face 125 thereof. Plates 126 and 126*a* are secured in position by screws 126*c,* heads of which engage plate 126 and the shanks of which threadably cooperate with plate 126*a* so as to both mechanically and electro-conductively couple the plates while securing them in fixed relation to contact lever 123. Plates 127, 127*a* are secured to the contact lever by screws 127*c.* Contact plates 126, 126*a* are respectively spaced like distances from contact plates 127, 127*a* by insulating ribs 128 amd 128*a* which are of a width which precludes electro-conductive bridging thereof by a contact of the group 151–174.

A flange 129 extends upwardly from base 111 toward contact lever 123. Laterally of flange 129 respective compressible spacers 130, 131 are provided. Contact carrier blocks 132 and 133 respectively outboard of spacers 130 and 131 are secured by mounting screws 134, 135 which cooperate with nuts 134n and 135n so that compressive forces may be applied to contact carriers 132 and 133 urging them toward each other to load spacers 130 and 131 in compression as well. Contact carrier 132 has a plurality of even numbered contacts, numbered 152–174, and contact carrier 133 has mounted therein odd numbered contacts 151–173. The contacts are secured in fixed relation in the respective carriers 132 and 133 and press into contact with respective contact plates 126, 126*a,*127, 127*a* as may be presented to them depending upon the position in which contact lever 123 is pivoted about shaft 114. The force with which the contacts 151–174 engage the respective plates 126, 126*a,*127, 127*a* may be adjusted by increasing or decreasing compressive forces applied through screws 134,135 in cooperation with nuts 134*n,*135*n.* The contact force both assures good electroconductivity between the respective contacts and plates and also provides frictional braking forces to swinging of contact lever 123 about shaft 114 and the magnitude of the braking is adjustable by adjusting the compressive force applied through screws 134,135 and nuts 134*n,*135*n.* A pair of lugs 136,136*a* are provided in fixed relation to contact carrier 133 and support limit stop screws 137,137*a* extending in threaded engagement with and through said lugs. Screws 137,137*a* may be advanced axially by rotation toward or away from each other so as to position the end face 137*e* of screw 137 in one desired position of adjustment, and end face 137*f* of screw 137*a* in a preferred position of adjustment. End face 137*e* may cooperate with face 124*e* while end face 137*f* may cooperate with abutment face 124*f* of arm 124*a* of limit lever 124. The stop screw 137 may be adjusted such that when pedal 116 as viewed in FIG. 5 is pivoted clockwise about shaft 114 to place abutment face 124*e* in engagement with screw abutment end 137*e,* plate 127 will be in contact with even numbered contacts 152–174 and plate 127*a* will be in contact with odd numbered contacts 153–173, while plate 126*a* will be in contact with contact 151. Stop screw 137*a* is adjusted such that its stop end 137*f* is engaged by abutment face 124*f* of limit lever 124 in a limit position of counterclockwise movement of pedal 116, as viewed in FIG. 5. When stop screw face 137*f* is in engagement with abutment face 124*f,* contact plate 126 is in contact with even numbered contacts 152–172 and contact plate 126*a* is in contact with odd numbered contacts 151–173, while contact 174 is in contact with plate 127. Thus, irrespective of the positioning of contact lever 124 in or between the limits of its movement, at least one contact of the group of contacts 151–174 inclusive is always out of contact with the pair of contact plates 126,126*a* or the pair 127,127*a,* while other contacts of that group are respectively in contact with a plate of one or the other of said pairs of contact plates.

A pair of switch contact carrier lugs 138,139 are respectively mounted in fixed position on contact lever 123 by screws 124*d* and 124*g.* Contact screws 140,141 in threaded cooperation with lug 138 and screws 142,143 in threaded cooperation with lug 139 are provided. Each of the screws 140–143 are threadedly engaged in the respective lug 138,139 and have a respective nut 140*n,*141*n,*142*n,*143*n* which may be rotated relative to the screw to perform both the conductor securing function and the function of locking the respective screw in adjusted relation to the respective lug. Switch lever 122 extends between lugs 138 and 139 as shown in FIGS. 5 and 6. Contact abutments 144, 145, 146, 147 are respectively secured on arm 122 in opposed relation to screws 140–143. Contacts 144 and 146 are joined by conductive tie bar 148, while contacts 145 and 147 are connected by tie bar 149 insulated from tie bar 148 by insulating sleeve 150. Contact screws 140 and 141 are adjusted axially so that they simultaneouusly respectively contact contacts 144 and 145 when switch lever 122 is moved clockwise about the axis of shaft 114 as in the relative position shown in FIG. 5. Similarly, contact screws 142 and 143 are axially adjusted such that when switch lever 122 is moved counterclockwise from the position in which it is shown in FIG. 5, the contacts 142 and 143 will simultaneously respectively contact the contacts 146 and 147. That is, the switch lever 122 moves from the full (C) line position to the dot-dot-dash (D) line position in FIG. 5. As shown in FIGS. 5 and 7, registering apertures 122*a,* 123*a,* and 124*a* are respectively provided in switch lever 122, contact lever 123 and limit lever 124 to function as a conduit and support for insulated conductors.

As shown diagrammatically in FIG. 5, a direct current power source 175 (shown schematically in FIG. 5), such as an automobile wet storage battery, is conventionally used to provide power for electric trolling motors, such as motor 40, and the same power source may be used to furnish power for the preferred embodiment of the instant invention in electric steering of boats propelled by use of such motors. From the battery 175 positive lead 176 and negative lead 177 respectively extend in electroconductive relation to the bars 149, 148.

The positive lead 176 is further extended by conductor 176*a* to propulsion motor control switch 178 from which conductor 176*b* extends through cable 43 into housing 15 from which it exits through hollow torsion spring 31 and staff 17 into housing 40 wherein it is connected to one terminal of the propulsion motor. Similarly, negative lead 177 extends from bar 148 by conductor 177*a* through registering conduit apertures 122*a*, 123*a* and 124*a*, and thence through cable 43 to housing 15 from which it exits through hollow torsion spring 31 and staff 17 into propulsion motor housing 40 wherein it is connected to a second terminal of the propulsion motor. Switch 178 is a normally open switch which may be closed by foot pressure upon button 178*b* to energize the circuit, and the propulsion motor will operate until switch 178*b* is permitted to open.

As shown in FIG. 5, contact 140 is connected to terminal 179*a* of switch 179 by conductor 179*c*. Terminal 179*a* is also connected to contact 143 by conductor 180. Contact 141 is connected by conductor 181 to contact plate 127 at 181*a* which, as previously mentioned, is in continuous electroconductive relation to contact plate 127*a*. Contact 142 is connected by conductor 182 to contact plate 126 at 182*a* which, as previously explained, is in continuous electroconductive relation to contact plate 126*a*.

When control lever 179*l* is manipulated to close switch 179, the electro steering circuit is placed under the control of the foot pedal 116 and operates as follows. When the heel portion of foot pedal 116 is depressed, that is, the pedal 116 is urged to move clockwise about shaft 114 as viewed in FIG. 5, switch lever 122 moves into the position in which it is shown in FIG. 5, placing contact 141 in electroconductive relation to contact 145 which is by bar 149 and conductor 176 connected to the positive terminal of battery 175 and also placing contact 140 in electroconductive relation to contact 144 which is by bar 148 also connected to contact 146 and by conductor 177 is connected to the negative terminal of battery 175.

Conductor 181 is connected to contact 141 and at 181*a* to contact plate 127 which in turn is in continuous electroconductive relation to contact plate 127*a*. Similarly, contact 142 is by conductor 182 connected at 182*a* to contact plate 126 which in turn is in continuous electroconductive relation to contact plate 126*a*. Depending upon the positioning of contact lever 123, a selected one or more of the contacts 151 through 174 will be in contact with a respective plate pair 126, 126*a*, or 127, 127*a*, while the position of switch lever 122 determines which pair of contacts 126–126*a* or 127–127*a* is energized, so that contacts supported in electroconductive relation to the energized pair of plates 126–126*a* or 127–127*a* will result in energizing of corresponding contacts in the housing 15, namely, some of the contacts 51 through 74. Contact 140 is connected to terminal 179*a* of switch 179 by conductor 179*c* and that terminal is also connected by conductor 180 to contact 143. Conductor 105 extends from terminal 179*b* through cable 43 into housing 15 and therein through conductor 110 is connected to one of the terminals of steering motor 36. The circuit continuing from the steering motor includes conductor 80 which is connected to conductor 75 which in turn is connected to brush contact 46. Brush contact 46 is in continuous electroconductive relation to contact ring 45 through which it is connected to wiper contact arm 44 which, as previously explained, rotates during operation of motor 36 to contact successive contacts 51 through 74 in the housing 15 until the steering motor circuit is opened when arm 44 moves into a position in which it does not contact an energized contact of the set 51–74.

To steer a boat through the use of the disclosed embodiment of the invention, switch 179l is closed and the operator's foot placed upon pedal 116. The pedal 116 may be moved either clockwise or counterclockwise about shaft 114 between the limits of movement established by cooperation of end 137*e* of stop screw 137 with lug face 124*e* which is the limit of clockwise rotation and between face 137*f* of stop screw 137*a* with lug face 124*f* which establishes the limit of counterclockwise movement of the pedal as viewed in FIG. 5. When the pedal 116 is pivoted from the position in which it is shown in FIG. 5 toward the limit position of counterclockwise movement about shaft 114 (as viewed in FIG. 5), switch lever 122 will be pivoted counterclockwise from the position in which it is shown in FIG. 5 into the position in which contacts 146 and 147 are in electroconductive relation to respective contacts 142 and 143, in which position the positive terminal of battery 175 is connected to steering motor 36 through conductor 110 while the negative terminal of the battery is connected to contact plates 126 and 126*a* on the contact lever with which contacts 151–160 are initially in contact. When pedal 116 is shifted to the limit position of counterclockwise movement, contacts 152 through 173 are in electroconductive contacting relation to either plate 126 or 126*a* and corresponding contacts 51 through 73 in the housing 15 are thus placed in electroconductive relation to the negative terminal of battery 175, as well. As long as wiper arm 44 is in contact with any one or more of the contacts 51 through 73 in the housing, current will be supplied from the battery to motor 36 to rotate shaft 22 carrying the propulsion motor and housing 40 as well as wiper arm 44, and such rotation will continue until the wiper arm 44 lies between contacts 73 and 51 in the housing, a position in which it is only in contact with contact 74 therein which, as previously noted, is not connected to the negative terminal of battery 75. As foot pedal 116 is moved from the full counterclockwise limit position clockwise toward the opposite limit position, switch lever 122 will first move clockwise to the position relative to contact lever 123 as shown in FIG. 5 while contact lever 123 remains stationary under the frictional resistance produced by engagement of plates 126, 126*a* and 127, 127*a* by the contacts 151–174 until contacts 144 and 145 are moved into electroconductive relation to contacts 140–141. Such movement of switch lever 122 effects a reversal of polarity in the steering motor operating circuit and thus works a reversal of the direction of rotation of motor 36 and also works a disconnection of plates 126 and 126*a* followed by connection of plates 127 and 127*a* to battery 175 with which contact 174 alone is in electroconductive relation when contact lever 123 is in the limit position of counterclockwise rotation. Further clockwise movement of pedal 116 will be accompanied by movement of contact lever 122 in unison therewith to bring successive contacts 173, 172, etc. into electroconductive relation with either plate 127 or 127*a* thereby successively energizing contacts in addition to contact 74, namely, 73, 72, etc. in the housing. As motor 36 is reversed by the above mentioned change of polarity, wiper arm 44 is moved in the opposite direction and continues to move as long as motor 36 operates, and operation of motor 36 will continue as long as wiper arm 44 is in engagement with one or more energized contacts numbered 74 through 51. When arm 44 moves out of engagement with energized contacts, the circuit again opens and motor 36 stops. Split clamp 117 frictionally biases pedal 116 against movement about shaft 114, keeping contacts 140, 141 respectively in contact with contacts 144, 145. Further clockwise pivoting of pedal 116 energizes contact engaged by arm 44 and possibly others of lower number and steering motor 36 turns staff 17 further. Reversal of the direction of pivoting of pedal 116 results in reversal of polarity and direction of drive by motor 36.

As placing of the foot on pedal 116 in a way as works a tilting thereof about axis 114 normally closes switch 178, the propulsion motor in housing 140 is operated as desired, but if it is desired to avoid operation of that motor, the foot engaging the pedal 116 may be canted so as to permit switch 178 to open while the steering mechanism is operated to place the propulsion motor in the desired or approximately desired position before placing the propulsion motor again in operation. The position of the propulsion motor is indicated by the pointer 41.

It will be apparent that the positioning and spacing of the control (unit including pedal 116) with reference to the outboard motor (with housing 15 included therein) is substantially limited only by the dimensions of the cable 43, and, if desired, suitable coupling terminals may be provided in housing 15 and on base 111 such that a cable 43 equipped with cooperating terminals and of desired length may be used in connecting the conductors in housing 15 with those forming part of the control unit having base 111.

The disclosed embodiment of the instant invention illustrated in the drawings and described above is subject to structural modification without departing from the spirit and scope of the appended claims.

Having described our invention, what we claim as new and desire to secure by letters patent is:

1. Steering mechanism for a boat motor having a shaft which turns to turn the boat motor which comprises a steering motor connected to turn the shaft, a plurality of first contacts spaced circumferentially around the shaft, a sweep contact mounted on the shaft and sequentially engageable with the first contacts as the shaft turns, a pedal, means for pivotally mounting the pedal, a contact plate means, means for causing the contact plate means to move with the pedal, a plurality of second contacts engageable with the contact plate means, means connecting each first contact with a respective one of the second contacts, and power means connected to drive the steering motor when steering motor operating power from the power means flows through the sweep contact while said sweep contact engages one of the first contacts which is connected to a second contact in engagement with the contact plate means, the flow of steering motor operating power through the sweep contact and the steering motor stopping when the sweep contact reaches a first contact connected with a second contact that is free of the contact plate means.

2. Steering mechanism as in claim 1 wherein the contact plate means includes two contact plate portions, means is provided for connecting one of the contact plate portions in series between the power means and the steering motor when the pedal is moved in one direction and for connecting the other contact plate portion in series between the power means and the steering motor when the pedal is moved in an opposite direction, the steering motor being reversible, and means for reversing polarity of the connection between the power means and the steering motor with change of contact plate portion connection so that the direction of steering motor advance is reversed with change in the direction of pedal movement.

3. Steering mechanism as in claim 1 wherein the steering motor is connected to the shaft by a worm in cooperating engagement with a worm wheel secured to the shaft for rotation therewith.

4. Steering mechanism as in claim 3 wherein the worm and worm wheel cooperate to secure the shaft against rotation when said power means is not connected to drive the steering motor.

5. Steering mechanism as in claim 1 wherein the shaft which turns to turn the boat motor comprises an intermediate protective coupling portion connecting a first portion connected to the steering motor and a second portion connected to the boat motor, said intermediate portion precluding transmission of undesired forces between said first and second portions.

6. Steering mechanism as in claim 5 wherein the intermediate protective coupling portion is a torsion spring.

7. Steering mechansim as in claim 1 wherein the means for pivotally mounting the pedal includes brake means which secure the pedal against pivoting movement until a force exceeding a predetermined minimum magnitude is applied to pivot the pedal.

8. Steering mechanism as in claim 7 wherein the brake means includes means for securing the brake means at a predetermined set as selected.

9. Steering mechanism as in claim 1 wherein switch means for controlling the supply of power to the boat motor is provided on the pedal to correlate supply of power to the boat motor with operation of the steering mechanism.

10. Steering mechanism for a boat motor having an upright shaft which turns to turn the boat motor which comprises a reversible steering motor connected to turn the shaft, a plurality of first contacts spaced circumferentially around the shaft, a sweep contact mounted on the shaft and sequentially engageable with the first contacts as the shaft turns, a pedal, pivot means for pivotally mounting the pedal, a contact support plate pivotally mounted to swing about the pivot means, a pair of angularly spaced contact plates mounted on the contact support plate and swinging therewith, a plurality of angularly spaced second contacts engageable with the contact plates, means connecting each first contact with a respective one of the second contacts, first and second angularly spaced contact blocks mounted on the contact support plate, a pedal contact block mounted on the pedal between the first and second contact blocks, first block contact means on the first block engageable with first pedal block contact means on the pedal contact block to cause the contact support plate to swing with the pedal when the pedal is swung in one direction, second pedal block contact means on the second block engageable with the second pedal block contact means on the pedal block to cause the contact support plate to swing with the pedal when the pedal is swung in an opposite direction, a direct current power means connected to the power means to drive the steering motor in one direction when the pedal is moved in the one direction and the sweep contact engages one of the first contacts which is connected to one of the second contacts in engagement with one of the contact plates, the steering motor stopping when the sweep contact reaches a first contact connected with a second contact that is free of said one of the contact plates, and means connected to the power means to drive the steering motor in the other direction when the pedal is moved in the opposite direction and the sweep contact engages one of the first contacts in engagement with the other of the contact plates, the steering motor stopping when the sweep contact reaches a first contact connected with a second contact that is free of said other contact plate.

11. A steering mechanism as in claim 10 wherein the means connected to the power means includes means mounted on the contact blocks for reversing the direction of flow of current through the steering motor when the pedal contact block moves from one of the angularly spaced contact blocks to the other of the angularly spaced contact blocks to reverse the direction of advance of the steering motor.

12. Steering mechanism as in claim 10 wherein the means connected to the power means includes a double pole double throw switch which is actuated to reverse the polarity of power supplied to the steering motor upon reversal of the direction of pivotal movement of the pedal.

13. Steering mechanism as in claim 10 wherein the steering motor is connected to the shaft by a worm in cooperating engagement with a worm wheel secured to the shaft for rotation therewith.

14. Steering mechanism as in claim 13 wherein the worm and worm wheel cooperate to secure the shaft against rotation when said power means is not connected to drive the steering motor.

15. Steering mechanism as in claim 10 wherein the shaft which turns to turn the boat motor comprises an intermediate protective coupling portion connecting a first portion connected to the steering motor and a second portion connected to the boat motor, said intermediate portion precluding transmission of undesired forces between said first and second portions.

16. Steering mechanism as in claim 15 wherein the intermediate protective coupling portion is a torsion spring.

17. Steering mechanism as in claim 10 wherein the means for pivotally mounting the pedal includes brake means which secure the pedal against pivoting movement until a force exceeding a predetermined minimum magnitude is applied to pivot the pedal.

18. Steering mechanism as in claim 17 wherein the brake means includes means for securing the brake means at a predetermined set as selected.

19. Steering mechanism as in claim 10 wherein switch means for controlling the supply of power to the boat motor is provided on the pedal to correlate supply of power to the boat motor with operation of the steering mechanism.

20. Steering mechanism as in claim 10 wherein the second contacts are resiliently supported to firmly engage the contact plates.

21. Steering mechanism as in claim 10 wherein the second contacts are supported in a carrier, and the carrier is resiliently supported to carry the second contacts to firmly engage the contact plates.

* * * * *